US006328471B1

(12) United States Patent
Culbertson

(10) Patent No.: US 6,328,471 B1
(45) Date of Patent: Dec. 11, 2001

(54) PINCH BOTTOM BAG WITH EASY OPEN FEATURE

(75) Inventor: Edward D. Culbertson, Lonoke, AK (US)

(73) Assignee: Stone Container Corporation, Chicago, IL (US)

( * ) Notice: Subject to any disclaimer, the term of this patent is extended or adjusted under 35 U.S.C. 154(b) by 0 days.

(21) Appl. No.: 09/456,342

(22) Filed: Dec. 8, 1999

(51) Int. Cl.[7] ..... B65D 33/18
(52) U.S. Cl. ..... 383/205; 383/85; 383/109
(58) Field of Search ..... 383/88, 85, 109, 383/200, 205, 123, 124, 906

(56) References Cited

U.S. PATENT DOCUMENTS 2,956,724 * 10/1960 Owens ..... 383/200
3,227,359 * 1/1966 Hanlon ..... 383/124 X
3,565,328 * 2/1971 Hudson ..... 383/205
4,441,613 4/1984 Hain et al. .
4,471,875 9/1984 Hain et al. .
4,480,752 * 11/1984 Jacobs ..... 383/205
4,512,479 4/1985 Hain et al. .
4,515,273 * 5/1985 Jacobson et al. ..... 383/205
4,557,385 * 12/1985 Robinson ..... 383/200
4,567,987 2/1986 Lepisto et al. .
5,114,243 * 5/1992 Thier ..... 383/88 X

* cited by examiner

*Primary Examiner*—Jes F. Pascua
(74) *Attorney, Agent, or Firm*—Dick and Harris

(57) ABSTRACT

A pinch bottom bag construction, for a multiwall bag, incorporating an easy open feature, which permits the controlled opening of a portion of the mouth opening of the bag, to create a spout-like opening, without requiring the use of an implement or an embedded tearstrip.

10 Claims, 4 Drawing Sheets

PINCH BOTTOM BAG WITH EASY OPEN FEATURE

BACKGROUND OF THE INVENTION

1. The Field Of The Invention

The present invention relates in general to multiwall pinch bottom bags, of the type, which are typically fabricated as a tube formed from one or more paper plies.

2. Background Of the Invention

Multiwall bags, fabricated as tubes formed from a plurality of paper plies, are known. Typically, the ends of the tubes are cut, so that when the end or ends of the bag are flattened, the plies of the bag, on both sides of the mouth opening of the bag, are provided with steps. The stepped-end cut pattern creates a closure flap on one side (the "high" side) of the mouth opening of the bag. The side of the bag on the opposite side of the mouth opening is the "short" side. Closure of the bag is typically accomplished by applying adhesive (e.g., hot melt or sonically activatable adhesive) to the outer surface of the short side of the bag. In addition to, or alternative to, providing adhesive on the face of the bag, adhesive may be applied to the inside surface of the closure flap. When the closure flap is folded over the mouth opening of the bag, preferably, the stepped plies of the flap substantially align with and overlie correspondingly cut steps in the bag plies on the face of the bag on the short side of the mouth opening.

Closing the bag by simply folding and adhesively affixing the flap provides the pointed, pinch bottom closure. The opposite end of the bag may be likewise provided with a pinch bottom closure, or it may be closed and sealed in a different configuration, such as a diamond- or rectangular configuration, so that the pinch "bottom" may actually be the top of the bag, as may be found commonly in bags containing dry granular material, like dog food or cat litter.

In addition to having paper plies, one or more plies, typically the innermost one or more plies, may be fabricated from a thin plastic material, or may be coated with a resinous material, to provide a degree of moisture resistance to the finished bag.

While the bag may be formed initially as a simple flattened tube, with folded closure flaps, pinch bottom bags are also known, in which typically both sides of the bag are gusseted, so that there are inward V-folds at each side of the bag, prior to folding the closure flap. Often, because of the stepped-end cutting of the bag plies, in the region of the gussets, the bag material extends beyond the topmost edge of the innermost ply of bag material on the "short" side of the mouth opening, so that in folding over and affixing the closure flap, the tops of the gussets are likewise folded over and captured by the closure flap. Such a prior art gusseted pinch bottom bag is disclosed in Goodrich, U.S. Pat. No. 4,008,850.

When such a bag is closed and sealed, the folded over closure is typically quite strong, and requires cutting of the bag plies, below the folded over and sealed closure, in order to gain access to the contents of the bag.

In order to facilitate opening of such bag structures, multiwall bag structures are known that incorporate tear structures that may be formed by extended perforations, usually in parallel pairs, through one or more plies of the bag, or by providing ripcord structures that are embedded in the bag plies, that lead to pull tabs, that extend to the outer surface of the bag. Such prior art bag opening structures are disclosed in such references as EP 0 596 747 A1; Rodkey, U.S. Pat. No. 3,272,424; Allen, U.S. Pat. No. 2,560,535; Brady et al., U.S. Pat. No. 2,870,955; Vogt, U.S. Pat. No. 4,088,264; Robinson, U.S. Pat. No. 4,557,385; Jacobs, U.S. Pat. No. 4,768,654; Lepisto et al., U.S. Pat. No. 4,483,445; and Thrall, U.S. Pat. No. 5,281,027.

Whether opened by the simple expediency of a cutting or piercing implement, or whether opened through a prior art opening mechanism such as those disclosed in the aforementioned references, typically, opening of the bag either requires substantial effort and/or results in a ragged opening that may include opening the entire mouth of the bag. When the contents of such an opened bag are poured out, because the entire mouth has been opened there is little control over the contents, and undesired spilling of the contents may occur.

It would be desirable to provide a multiwall bag formed from one or more plies of bag material, of which at least the outermost ply or plies is/are formed from paper, that has an easy open feature, to enable facilitated access to the contents of the bag, without requiring the use of a cutting or piercing implement.

It would also be desirable to provide a multiwall bag, such as a pinch bottom closure bag, that is provided with a secure closure, but which is also provided with an easy open feature, which creates a controlled opening of only a portion of the mouth of the bag, for controlled dispensing of the contents of the bag.

These and other desirable features of the present invention will become apparent in light of the present description, claims and drawings.

SUMMARY OF THE INVENTION

The present invention is directed to a bag apparatus for the containment of material. The bag apparatus comprises a tubular bag body fabricated from at least one ply of material. The tubular bag body has a longitudinal axis. The tubular bag body further has at least one end configured to form an elongated mouth opening and having first and second opposing sides adjacent the mouth.

The at least one ply of the tubular bag body at the at least one end is step cut, to define a long step, on one side of the elongated mouth opening, of at least one ply extending above the elongated mouth opening, and a short step, on the opposite side of the elongated mouth opening, of at least one ply extending substantially below the mouth opening.

A portion of at least one of the at least one ply of the long step is operably configured to be folded across the mouth and over and against at least a portion of an outer surface of at least one of the at least one ply of the short step, for enabling sealing of at least a portion of the long step to the short step, following application of an adhesive material to exposed surfaces of at least one of the long step and the short step.

A tab portion is disposed in at least one of the at least one ply in the short step, extending from a side edge of the tubular bag body across a portion of the width of the tubular bag body and terminating in an inner longitudinal edge, the tab portion further extending longitudinally beyond the mouth opening, to overlie a portion of at least one of the at least one ply of the long step, so that upon the application of adhesive material to at least one of the exposed surfaces of the long step and the short step, the tab portion shields a portion of an inner surface of the long step from the adhesive material.

A longitudinally extending cut is disposed in the at least one ply of the long step that has been shielded from adhesive, at a transverse position proximate the inner longitudinal edge, to enable the outer at least one ply of the long step to be torn, in a direction from the longitudinally extending cut, toward the side edge of the tubular bag body, to expose a portion of the mouth opening of the bag to, in turn, create a spout at said side edge of the tubular bag body.

In an alternative embodiment of the invention, the tubular bag body is fabricated from at least two plies of material, the long step is defined by at least two plies extending above the elongated mouth opening, and the short step is defined by at least two plies extending substantially below the mouth opening.

In a preferred embodiment of the invention, the tubular bag body is formed from at least three plies of material. The long step is formed by at least three plies of material, and the tab portion shields portions of at least two plies of material in the long step. In this embodiment, a longitudinally extending cut is disposed in each of the at least two plies of material in the long step that are shielded from adhesive; and the two longitudinally extending cuts are transversely spaced from one another. The longitudinally extending cut in the innermost of the at least two shielded plies in the long step is disposed further from the side edge of the tubular bag body than other at least one the longitudinally extending cut, with the longitudinally extending cut in each successive outwardly disposed ply being disposed closer to the side edge of the tubular bag body than the adjacent inwardly disposed ply.

In one embodiment of the invention, each ply of the tubular bag body is fabricated from paper. In an alternative embodiment of the invention, at least one ply of the tubular bag body is fabricated from a plastic material.

In a preferred embodiment of the invention, the tab portion extends a transverse distance across the tubular bag body that is no greater than one-half the total width of the tubular bag body.

DETAILED DESCRIPTION OF THE INVENTION

Figure 1:
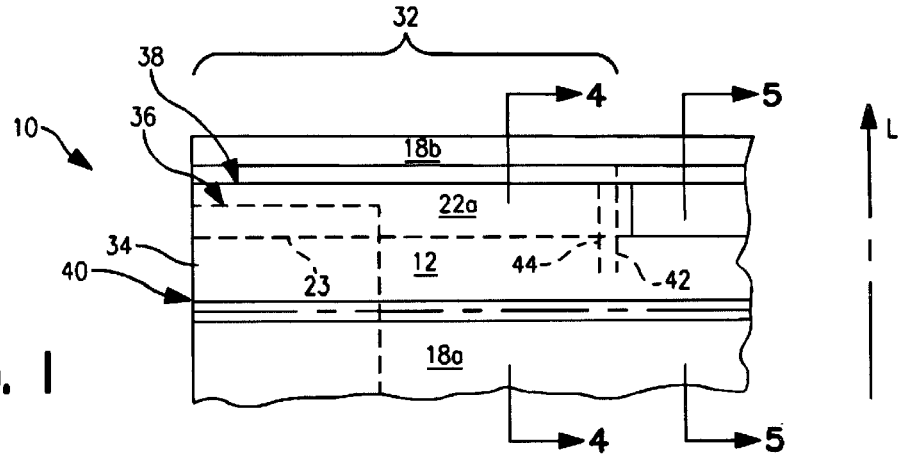
FIG. 1 is a fragmentary front elevation of one end of a pinch bottom bag, according to a preferred embodiment of the invention, in which the flap is unfolded and the mouth of the bag

While this invention is susceptible of embodiment in many different forms, there are shown in the drawings and will be described in detail herein, several specific embodiments, with the understanding that the present invention is to be considered as an exemplification of the principles of the invention and is not intended to limit to the invention to the embodiments illustrated.

Figure 2:
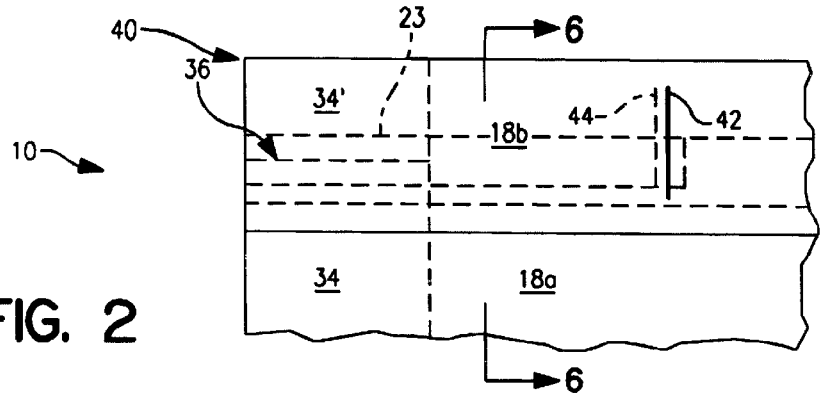
FIG. 2 is a fragmentary front elevation of the pinch bottom bag, according to the embodiment of FIG. 1, in which the closure flap has been folded over and affixed to the outer face of the short side of the mouth opening.
Figure 3:
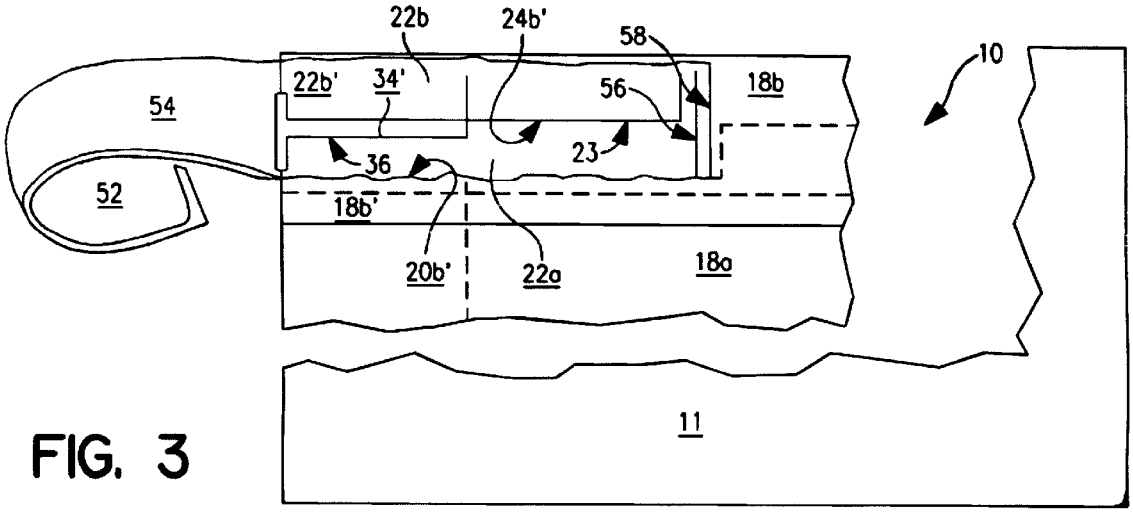
FIG. 3 is a fragmentary front elevation of the pinch bottom bag, according to the embodiment of FIGS. 1 and 2, in which a finger or stylus has been inserted into the bag opening slits, and the outer plies of the closure flap have been torn away, to expose a portion of the bag mouth opening, to create a controlled pour spout structure.

FIG. 1 is a fragmentary front elevation of one end of a pinch bottom bag, according to a preferred embodiment of the invention, in which the flap is unfolded and the mouth of the bag Bag 10 is, in a preferred embodiment of the invention, a multiwall bag having a pinch bottom type of closure structure, at least at one end. Aside from the structure of the corner of the bag that is illustrated in FIGS. 1–3, in particular, the remaining structure of bag 10 may be of otherwise conventional construction. The structure illustrated in FIGS. 1–3 is expected to represent, typically, the left approximately one-quarter to one-third of the width of bag 10. The remainder 11 of bag 10 is represented by the fragment of the diagonally opposite corner of bag 10.

Figure 4:
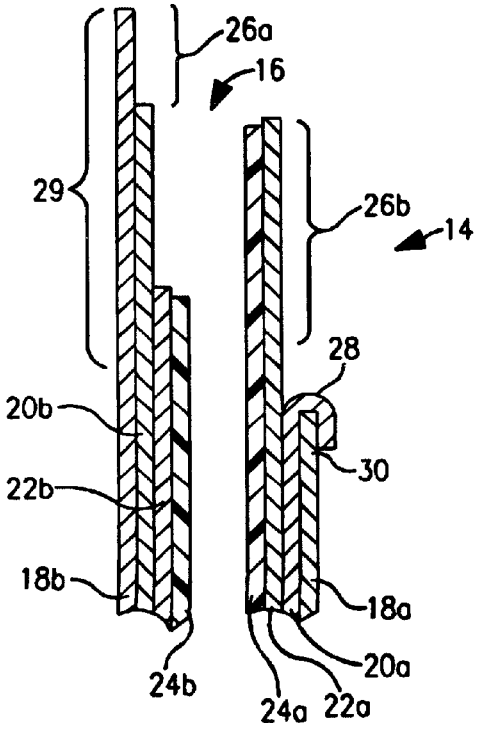
FIG. 4 is a fragmentary side elevation, in section, of the pinch bottom bag of FIG. 1, viewed in the direction of line 4—4 of FIG. 1, in which the closure flap has not been folded over, exposing the mouth opening of the bag, and in which the elongated step on the short side of the bag is shown.
Figure 5:
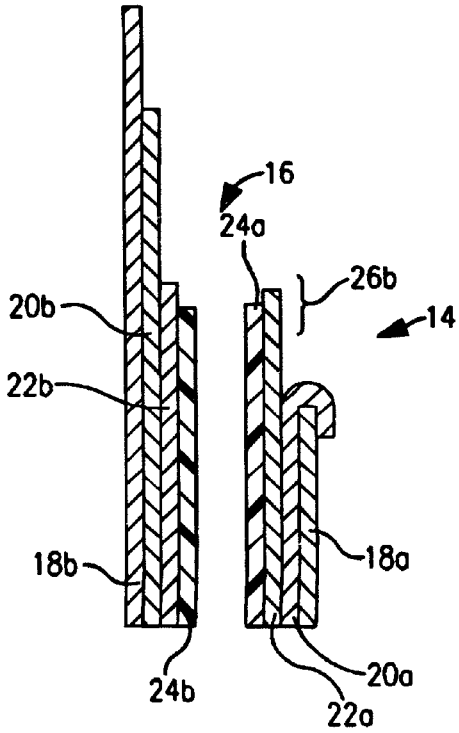
FIG. 5 is a fragmentary side elevation, in section, of the pinch bottom bag of FIG. 1, viewed in the direction of line 5—5 of FIG. 1, showing the reduction of the length of the innermost plies of the short side of the mouth opening, which permits greater areas of the inner surfaces of the closure flap to engage the outer surfaces of the bag on the short side of the mouth opening.

Bag 10 is constructed as a tubular body 12 formed from a plurality of plies of material. Referring to FIG. 4, bag 10 has an end 14, including mouth opening 16. After tubular body 12 is formed, preferably as part of a continuous tube web from a tube forming machine (not shown), using conventional bag tube forming techniques, the elongated tube web is flattened, and the web cut into discrete tubular bodies 12. In the cutting process, the ends of each successive bag 10 are step-cut, to create an end structure and profile as illustrated in FIGS. 1 and 4.

In the embodiment of FIGS. 1–6, bag 10 is formed from four plies. In the flattened configuration of the cut tubular body 12, the four plies of bag material define the bag structures on the opposite sides of mouth opening 16. For example, outermost ply 18*a* on the short step (front side) of mouth opening 16 is the same ply of material as outermost ply 18*b* on the long step (closure flap side). Similarly, plies 20*a* and 20*b,* plies 22*a* and 22*b,* and plies 24*a* and 24*b,* respectively, represent the short step and long step portions of the same respective plies of material forming the successive plies of tubular bag body 12.

In a preferred embodiment of the invention, the top edges of plies 22*b,* 24*b* (generally indicated by line 23 in FIGS. 1–3) are substantially even with one another, and, in the region 32, are substantially longitudinally spaced from the topmost edges of plies 18*b,* 20*b,* 24*a* and 22*a,* as indicated in FIG. 4.

In one embodiment of the present invention, a plastic film is utilized to provide a moisture-proof or resistant ply to bag 10; to form innermost plies 24*a* and 24*b*. Alternatively, bag 10 may be constructed entirely from paper material. In any even, the outer ply or plies that form the structure for the easy open feature should be fabricated from a material, whether paper, plastic or other, that is susceptible of tearing without the intervention of a cutting or piercing implement. Similarly, bag 10 may be provided with a greater or less number of plies, although three or more plies are preferred, for reasons that will become apparent.

In the presently illustrated embodiment of the invention, activatable adhesive material is deposited on (or hot melt adhesive is applied to) surface regions 26*a* and 26*b*. Alternatively, the short step surfaces of tubular body 12 corresponding to surface regions 26*a,* 26*b* and 26*c,* when long step (closure flap) 28 is folded over, may be provided with adhesive material.

In addition, the topmost edge 28 of ply 20*a* may be folded over and adhesively secured to the topmost edge 30 of ply 18*a*. Alternatively, the topmost edges of plies 18*a* and 20*a* may be flush cut (not shown).

An important aspect of the structure of the bag of the present invention is the manner in which the upper edge regions of the innermost ply(s) on the short (front) side of the bag are step cut. Specifically, the innermost plies 22*a* and 24*a* of the short step are lengthened relative to the longitudinal axis L (FIG. 1) of bag 10, for a short distance along the transverse width of the short step. As previously mentioned, the transverse width of the composite lengthened portion 32, formed by lengthened portions of innermost plies 22*a,* 24*b,* typically will represent approximately one-quarter to one-third of the total width of bag 10, though, the specific fraction of the total width may vary from application to application, and may be a greater or lesser fraction.

Bag 10, in a preferred embodiment of the invention is gusseted, with the several plies of tubular bag body 12 being folded inwardly in two V-folds, one on each side of mouth opening 16. For example, the left-side gusset 34 of bag 10 is illustrated in phantom lines in FIGS. 1 and 2. The topmost edges 36 of the plies of bag material, that make up gusset 34 are preferably "below" the topmost edge of composite lengthened portion 32, but are positioned above the line, generally indicated by reference numeral 40, along which long step (closure flap) 29 and the short step will be folded to close the bag end.

The previously mentioned elongated portion of the innermost plies of the short step forms part of the structure that provides the easy-opening feature of the present invention. Another part of the structure is provided by longitudinal cuts 42, 44, that are placed in the outermost plies 18*b* and 20*b,* respectively, of the long step. Cuts 42, 44 preferably are staggered, with respect to the transverse width of bag 10, so that cut 42 in outermost ply 18*b* is further away from the side edge of the bag, than the cut 44 in the next-to-outermost ply 20*b*. However, the easy open feature of the present invention will also work, if the cuts are directly aligned with one another.

When the adhesive (not shown) is applied to the previously indicated areas 26*a,* 26*b* and 26*c* of the outer and short steps, the extended portion 32 of the short step prevents adhesive from contacting the area of ply 20*b* that is "underneath" extended portion 32, as viewed in FIG. 1. Accordingly, when the long step and short step are folded over, along line 40, portions of plies 18*b* and 20*b* that are to the left of cuts 42, 44 are not directly adhered to the immediately adjacent ply 24*a* of the short step, except at the "top" edge of ply 24*a,* where it contacts ply 20*b* there may be some adherence, as a result of activated adhesive or hot melt working between the two plies, as a result of capillary action or through the compression which typically accompanies the closing and sealing procedure.

Figure 6:
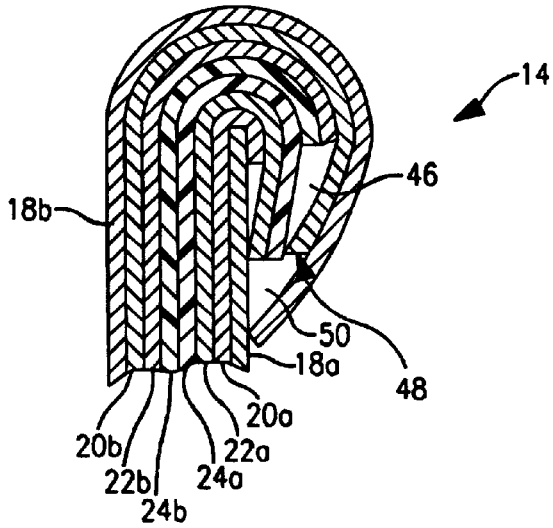
FIG. 6 is a fragmentary side elevation, in section, of the pinch bottom bag of FIG. 2, viewed in the direction of line 6—6 of FIG. 2, showing how the several plies of the closure flap and the short side of the bag mouth opening, are folded over, when the bag end is closed.
Figure 7:
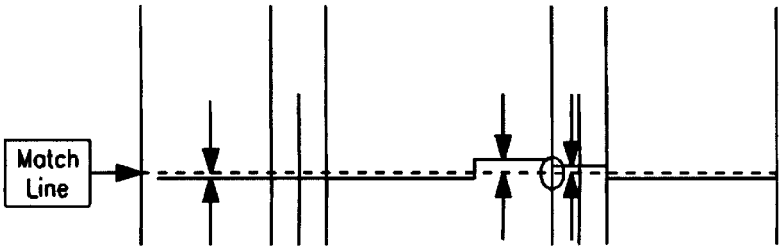
FIG. 7 is a schematic illustration of the perforator bar pattern for cutting of the web for forming the innermost paper ply of a bag in accordance with the embodiment of FIGS. 1–3, prior to joining of the innermost paper ply to the other paper plies, and tubing of the joined plies and subsequent severing into separate bag tubes, and showing spot paste application, if applicable.

Referring to FIG. 6, when the bag end 14 is folded and sealed, region 46, between plies 22*b* and 24*a,* left of cuts 42, 44, is substantially free of adhesive material, as a result of the previously described pattern of adhesive placement. Some adhesive may work its way into edge region 48, but in preferred embodiments of the invention, will not extend substantially into region 46. Adhesive material preferably will, however, substantially fill region 50, to ensure secure closing and sealing of the bag. Please note that the apparent roundness of the fold-over in FIG. 6 is merely the result of exaggeration of the thickness of the plies, for ease of illustration. In actual embodiments of the invention, the inner and long steps will be folded over tightly, with a relatively sharp crease, as is customary in the folding and sealing of the ends of pinch bottom bags. Accordingly, notwithstanding the presence of cuts 42, 44 in a region that is absent adhesive material, because of the sharp crease along the top of the fold-over, the material that is ultimately contained within the bag, even if in finely granular form, will not tend to sift out of the bag through the cuts. While one or the other of the cuts may be prompted to open positions, by transient slackness in the plies of the bag, by staggering the widthwise locations of the respective cuts, as is done in preferred embodiments of the invention, a labyrinthine path is created, making it unlikely that both cuts would be prompted simultaneously to "open" positions.

In the folding and sealing process, the topmost portion 34' of gusset 34 is itself folded over, so that edge 36 faces downwardly, as shown in FIG. 2.

FIG. 3 illustrates the manner of opening of bag 10. Cuts 42, 44 preferably will have sufficient length, so that a finger, or a blunt stylus may be inserted, first, through cut 42, into the space between plies 18*b* and 20*b,* and then, proceeding toward the left edge of the bag, through cut 44, into the space between plies 20*b* and 22*a*. By grasping plies 18*b* and 20*b,* and using an outward pulling motion, elongated torn strips 52, 54 are created, leaving right-side edges 56, 58 of cuts 44, 42, respectively. Preferably, tearing of strips 52, 54 continues until the left edge of bag 10 is reached, so that strips 52, 54 separate from thin strips 18*b'* and 20*b'*of plies 18*b* and

20*b*. Strips 52, 54 may be completely torn off, or not, according to the wishes of the consumer. However, once strips 52, 54 have been torn to the extent shown in FIG. 3, topmost portion 34' of gusset 34 becomes exposed. Topmost portion 34' may then be unfolded upwardly, along with strips 22*b'* and 24*b'* of plies 22*b* and 24*b*, respectively. After topmost portion 34' has been unfolded upward, gusset 34 may be opened outwardly, and the remaining portions of the inner and long steps spread apart, at least from the opened gusset 34, rightward to approximately right-side edges 56, 58 remaining from cuts 44, 42. This creates a limited open mouth region or pour spout for controlled dispensing of the contained material within the bag.

Figure 8:
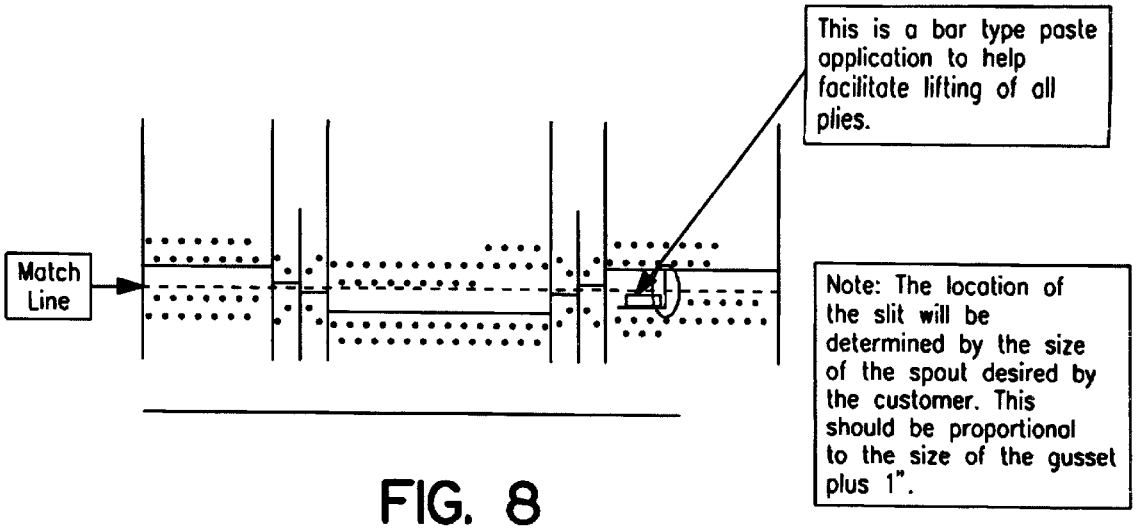
FIG. 8 is a schematic illustration of the perforator bar pattern for cutting of the web for forming the middle paper ply of a bag in accordance with the embodiment of FIGS. 1–3, prior to joining of the middle paper ply to the other paper plies, and tubing of the joined plies and subsequent severing into separate bag tubes, and showing spot paste application, if applicable.
Figure 9:
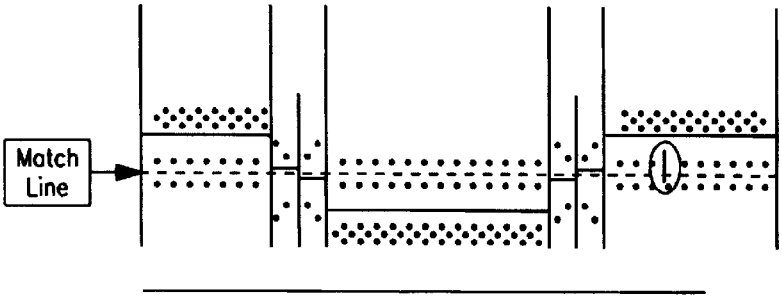
FIG. 9 is a schematic illustration of the perforator bar pattern for cutting of the web for forming the outermost paper ply of a bag in accordance with the embodiment of FIGS. 1–3, prior to joining of the outermost paper ply to the other paper plies, and tubing of the joined plies and subsequent severing into separate bag tubes, and showing spot paste application, if applicable, and showing spot paste application, if applicable.
Figure 10:
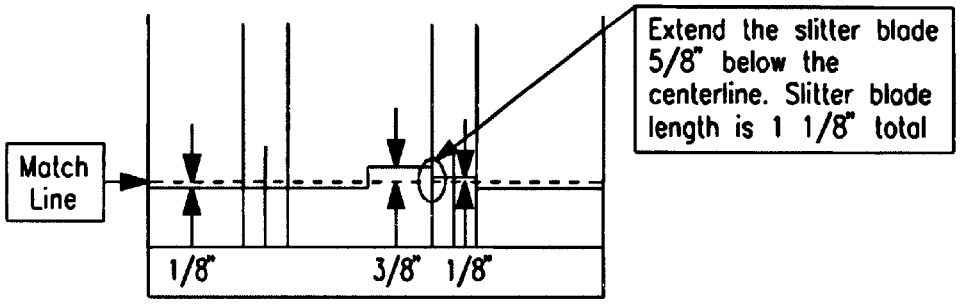
FIG. 10 is a schematic illustration of the perforator bar pattern for cutting of the web for forming the innermost paper ply of a bag in accordance with the embodiment of FIGS. 1–3, prior to joining of the innermost paper ply to the other paper plies, and tubing of the joined plies and subsequent severing into separate bag tubes, and showing placement of the perforations according to a preferred embodiment of the invention.
Figure 11:
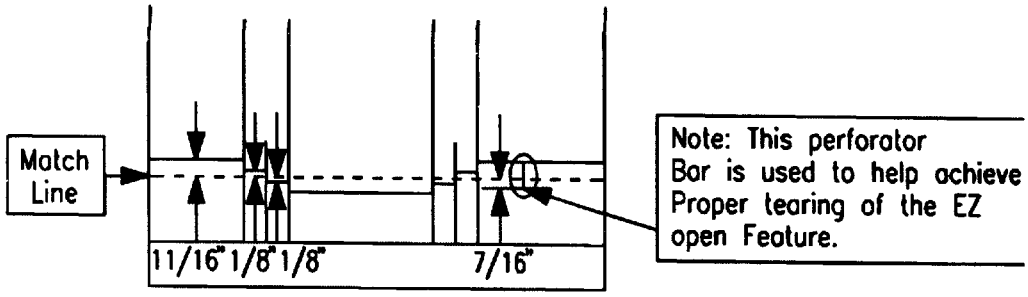
FIG. 11 is a schematic illustration of the perforator bar pattern for cutting of the web for forming the middle paper ply of a bag in accordance with the embodiment of FIGS. 1–3, prior to joining of the middle paper ply to the other paper plies, and tubing of the joined plies and subsequent severing into separate bag tubes, and showing placement of the perforations according to a preferred embodiment of the invention.
Figure 12:
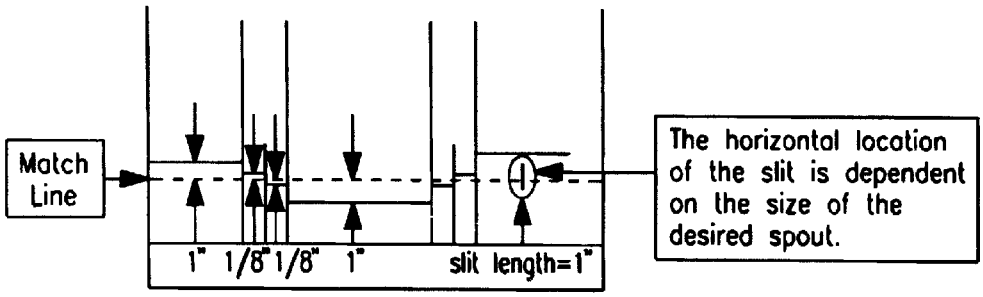
FIG. 12 is a schematic illustration of the perforator bar pattern for cutting of the web for forming the outermost paper ply of a bag in accordance with the embodiment of FIGS. 1–3, prior to joining of the outermost paper ply to the other paper plies, and tubing of the joined plies and subsequent severing into separate bag tubes, and showing placement of the perforations according to a preferred embodiment of the invention.

FIGS. 7–12 schematically illustrate, using illustration techniques recognizable by one of ordinary skill in the art, the pasting and perforation patterns for the three (inner, middle and outer) paper plies for the bag of the embodiment of FIGS. 1–3. FIGS. 8 and 9 in particular, illustrate, in the circled regions, the longitudinally extending slits, in the middle and outer plies that form the easy-open feature. In addition, FIG. 8 illustrates pasting that is positioned between the middle and outer plies immediately adjacent to the longitudinal slit, so that upon tearing, these two plies are held together. This facilitates tearing, and precludes the need for individually tearing each ply successively.

While the present invention employs four plies of material, one of which is plastic, the present invention may be employed in a bag having more plies or as few as two plies, as long as a portion of the innermost ply of the long step is shielded from application of adhesive, by a longitudinally elongated transversely extending portion of the innermost ply of the short step, with a longitudinal cut through the outermost ply of the long step at approximately the same transverse location as the innermost end of the longitudinally elongated transversely extending portion of the innermost ply of the short step.

Although the invention herein is described and illustrated with respect to a pinch bottom closure bag environment, it is to be understood that the principles of the present invention may be readily adapted to bag structures having other types of closure, such as a diamond- or square-bottom bag closure structure, so long as a stepped-end cutting pattern is employed, so that at least a portion of a long step is folded over and adhesively affixed to at least a portion of a short step.

The foregoing description and drawings merely explain and illustrate the invention, and the invention is not limited thereto except insofar as the appended claims are so limited, as those skilled in the art who have the disclosure before them will be able to make modifications and variations therein without departing from the scope of the invention.

What is claimed is:

1. A bag apparatus for the containment of material, comprising:

a tubular bag body, fabricated from at least one ply of material;

the tubular bag body having a longitudinal axis;

the tubular bag body having at least one end configured to form an elongated mouth opening and having first and second opposing sides adjacent the mouth;

the at least one ply of the tubular bag body at the at least one end being step cut, to define a long step, on one side of the elongated mouth opening, of at least one ply extending above the elongated mouth opening, and a short step, on the opposite side of the elongated mouth opening, of at least one ply extending substantially below the mouth opening;

a portion of at least one of the at least one ply of the long step being operably configured to be folded across the mouth and over and against at least a portion of an outer surface of at least one of the at least one ply of the short step, for enabling sealing of at least a portion of the long step to the short step, following application of an adhesive material to exposed surfaces of at least one of the long step and the short step;

a tab portion in at least one of the at least one ply in the short step, extending from a side edge of the tubular bag body across a portion of the width of the tubular bag body and terminating in an inner longitudinal edge, the tab portion further extending longitudinally beyond the mouth opening, to overlie a portion of at least one of the at least one ply of the long step, so that upon the application of adhesive material to at least one of the exposed surfaces of the long step and the short step, the tab portion shields a portion of an inner surface of the long step from the adhesive material; and a longitudinally extending cut, disposed in the at least one ply of the long step that has been shielded from adhesive, at a transverse position proximate the inner longitudinal edge, to enable the outer at least one ply of the long step to be torn, in a direction from the longitudinally extending cut, toward the side edge of the tubular bag body, to expose a portion of the mouth opening of the bag to, in turn, create a spout at said side edge of the tubular bag body.

2. The bag apparatus according to claim 1, wherein the tubular bag body is fabricated from at least two plies of material, the long step is defined by at least two plies extending above the elongated mouth opening, and the short step is defined by at least two plies extending substantially below the mouth opening.

3. The bag apparatus according to claim 2, wherein the tubular bag body is formed from at least three plies of material.

4. The bag apparatus according to claim 3, wherein the long step is formed by at least three plies of material.

5. The bag apparatus according to claim 4, wherein the tab portion shields portions of at least two plies of material in the long step.

6. The bag apparatus according to claim 5, wherein a longitudinally extending cut is disposed in each of the at least two plies of material in the long step that are shielded from adhesive; and the two longitudinally extending cuts are transversely spaced from one another.

7. The bag apparatus according to claim 6, wherein the longitudinally extending cut in the innermost of the at least two shielded plies in the long step is disposed further from the side edge of the tubular bag body than other at least one the longitudinally extending cut, with the longitudinally extending cut in each successive outwardly disposed ply being disposed closer to the side edge of the tubular bag body than the adjacent inwardly disposed ply.

8. The bag apparatus according to claim 1, wherein each ply of the tubular bag body is fabricated from paper.

9. The bag apparatus according to claim 1, wherein at least one ply of the tubular bag body is fabricated from a plastic material.

10. The bag apparatus according to claim 1, wherein the tab portion extends a transverse distance across the tubular bag body, that is no greater than one-half the total width of the tubular bag body.

* * * * *

UNITED STATES PATENT AND TRADEMARK OFFICE

CERTIFICATE OF CORRECTION

PATENT NO. : 6,328,471 B1
DATED : December 11, 2001
INVENTOR(S) : Culbertson

It is certified that error appears in the above-identified patent and that said Letters Patent is hereby corrected as shown below:

Title page,
Item [75], Inventor, delete "AK", and insert -- AR --

Column 3,
Line 41, after "bag", insert -- . -- (period)

Column 4,
Line 20, delete "and showing spot paste application, if applicable," (1st instance)
Line 54, after "limit", delete "to"
Line 59, after "bag", insert -- . -- (period)

Column 5,
Line 32, delete "even", and insert -- event --

Signed and Sealed this

Twenty-eighth Day of December, 2004

JON W. DUDAS
*Director of the United States Patent and Trademark Office*